US009477179B2

(12) United States Patent
Nakajima

(10) Patent No.: US 9,477,179 B2
(45) Date of Patent: Oct. 25, 2016

(54) IMAGE FORMING APPARATUS

(71) Applicant: CANON KABUSHIKI KAISHA, Tokyo (JP)

(72) Inventor: Takao Nakajima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/662,703

(22) Filed: Mar. 19, 2015

(65) Prior Publication Data

US 2015/0277287 A1 Oct. 1, 2015

(30) Foreign Application Priority Data

Mar. 25, 2014 (JP) ..... 2014-062358

(51) Int. Cl.
*G03G 15/08* (2006.01)

(52) U.S. Cl.
CPC ..... *G03G 15/0887* (2013.01); *G03G 15/0886* (2013.01); *G03G 15/0877* (2013.01); *G03G 15/0879* (2013.01); *G03G 15/0881* (2013.01); *G03G 2221/1654* (2013.01)

(58) Field of Classification Search
CPC ..... G03G 15/0877; G03G 15/0879; G03G 15/0881; G03G 15/0886
USPC ..... 399/260
See application file for complete search history.

(56) References Cited

U.S. PATENT DOCUMENTS

2010/0111573 A1* 5/2010 Yamada ..... G03G 15/0881 399/262
2010/0129118 A1 5/2010 Kimura et al.
2013/0322925 A1 12/2013 Fujii
2014/0153974 A1* 6/2014 Jimba ..... G03G 15/0879 399/262
2014/0376968 A1* 12/2014 Yamamoto ..... G03G 15/0886 399/258

FOREIGN PATENT DOCUMENTS

JP 2009-205172 A 9/2009
JP 2010-055035 A 3/2010
JP 2010-117658 A 5/2010
JP 2013-015826 A 1/2013
(Continued)

OTHER PUBLICATIONS

Search Report in European Patent Application No. 15160461.8, dated Sep. 1, 2015.

*Primary Examiner* — David Gray
*Assistant Examiner* — Tyler Hardman
(74) *Attorney, Agent, or Firm* — Fitzpatrick, Cella, Harper & Scinto

(57) ABSTRACT

Provided is an image forming apparatus including: a holding member holding a toner container with a discharge port, and a shutter opening/closing the discharge port and having a communicating port communicable with the discharge port; a connecting member forming a toner conveying path, and connecting to/retracting from the shutter in conjunction with an operation of mounting/removing the toner container; a first locking portion movable between a first position to locate the shutter in a non-communicating position and a second position to lock the shutter in a communicating position when the toner container is mounted; and a second locking portion locatable in a position to connect the connecting member to the shutter, and in a position to lock the connecting member in a position where the connecting member is separated away from the shutter when the toner container is mounted.

6 Claims, 13 Drawing Sheets

(56) References Cited

FOREIGN PATENT DOCUMENTS

| | | | | |
|---|---|---|---|---|
| JP | 2013-152361 | A | | 8/2013 |
| JP | 2013152361 | A | * | 8/2013 |
| JP | 2013-250428 | A | | 12/2013 |
| WO | 2012/169657 | A1 | | 12/2012 |

* cited by examiner

IMAGE FORMING APPARATUS

BACKGROUND OF THE INVENTION

1. Field of the Invention

The present invention relates to an image forming apparatus including connecting members that are arranged movably to a main body so as to be connectable to and separable from toner containers for containing a toner therein, in conjunction with an operation of mounting and removing the toner containers to enable formation of toner conveying paths.

2. Description of the Related Art

Hitherto, an image forming apparatus is required to be supplied with a toner along with the consumption of the toner. Therefore, the image forming apparatus includes a removable toner container. The toner container generally includes a shutter capable of opening and closing a discharge port so as not to leak the toner through the toner discharge port. The shutter is arranged so as to be opened in conjunction with an operation of mounting the toner container when the toner container is mounted to an apparatus main body.

As described in Japanese Patent Application Laid-Open No. 2013-15826, a toner container including a stretchable pump portion has been proposed hitherto. The toner container discharges the toner by a pressure generated when the pump portion is stretched and compressed.

An apparatus described in Japanese Patent Application Laid-Open No. 2013-15826 has the following configuration for preventing the toner discharged through the discharge port of the toner container by the pressure of the pump portion from leaking from the discharge port to spill out in the apparatus. Specifically, the apparatus includes a connecting portion that moves so as to be brought into contact with and separated away from the toner discharge port in conjunction with an operation of mounting and removing the toner container so that the discharge port of the toner container can be connected when the toner container is mounted. A toner conveying path capable of bringing the toner container and the toner receiving portion into contact with each other and separating the toner container and the toner receiving portion away from each other is arranged to enhance sealing properties.

SUMMARY OF THE INVENTION

According to Japanese Patent Application Laid-Open No. 2013-15826, the opening/closing operation of the shutter and the contacting/separating operation of the connecting portion are performed in conjunction with the operation of mounting and removing the toner container. In Japanese Patent Application Laid-Open No. 2013-15826, it is conceivable to ship the main body, in which the toner container is mounted, to be packed in the same package, for the purposes of reducing a packing size of the main body and saving packing materials for the toner container.

With the above-mentioned configuration, in the case that the toner container and the main body are packed in the same package, the shutter of the toner container is opened so that the toner container and the toner receiving portion are disadvantageously brought into communication with each other. Therefore, the toner flows from the toner container through the discharge port into the toner receiving portion located downstream during shipping. As a result, there is a fear of causing fluctuations in image density.

Therefore, the following configuration is desired. Specifically, for normal use, the shutter is opened in conjunction with the mounting of the toner container. When the toner container and the main body are packed in the same package and shipped, the shutter is not opened even when the toner container is mounted. To meet the requirements described above, the following configuration is conceived. When shipping the apparatus, a locking member is located in a position in which the shutter is not opened even when the toner container is mounted. When normally using, the locking member is moved to a normal position (in which the shutter is opened when the toner container is mounted).

If the above-mentioned configuration is adopted, however, the connecting portion is subjected to a shear force generated by a sliding operation of the shutter. As a result, there is a fear in that the sealing properties for the toner are impaired. Further, in a case where a sealing member having flexibility is used as the connecting portion, there is a fear in that the sealing properties for the toner are reduced due to deformation of the sealing member. Any configuration including the connecting portion to be connected to the toner container in conjunction with the mounting of the toner container has the same problems even if the toner container does not use the pump function as described in Japanese Patent Application Laid-Open No. 2013-15826.

The present invention has been made in view of the above-mentioned circumstances. Specifically, the present invention provides an image forming apparatus including a connecting portion that is connectable to a discharge port of a toner container in conjunction with an operation of mounting the toner container, in which the connecting portion can be separated away from the toner container when the toner container is mounted.

In order to achieve the above-mentioned object, according to one embodiment of the present invention, there is provided an image forming apparatus, including: an apparatus main body; a holding member configured to hold a toner container containing a toner and provided removably and mountably to the apparatus main body, wherein the toner container has a discharge port through which the toner is discharged and a shutter configured to be movable with respect to the toner container to open and close the discharge port, and wherein the shutter has a communicating port communicable with the discharge port and is configured to move relative to the toner container to open and close the discharge port; a toner receiving portion configured to receive the toner discharged from the toner container; a connecting member movably provided to the apparatus main body and enabling to form a toner conveying path between the toner container and the toner receiving portion, wherein the connecting member is configured to be movable, in conjunction with an operation of mounting and removing the toner container, between a position in which the connecting member connects to the shutter and a position in which the connecting member retracts from the shutter; a first locking portion movably provided to the apparatus main and lockable to the shutter, wherein, when the toner container is mounted, the first locking portion is provided movably between a first position to allow the shutter to locate in a non-communicating position in which the communicating port and the discharge port are not brought into communication with each other, and a second position to lock the shutter in a communicating position in which the communicating port and the discharge port are brought into communication with each other; and a second locking portion movably provided to the apparatus main body and lockable to the connecting member, wherein, when the toner container is mounted, the second locking portion is provided so as to be locatable in a position to allow the connecting member and the shutter to connect to each other, and in a position to lock the connecting member in a position in which the connecting member and the shutter are separated away from each other.

According to the one embodiment of the present invention, it is possible to provide the image forming apparatus including the connecting portion that is connectable to the discharge port of the toner container in conjunction with the operation of mounting the toner container, in which the connecting portion can be separated away from the toner container when the toner container is mounted.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiments

Image Forming Apparatus

Figure 1:
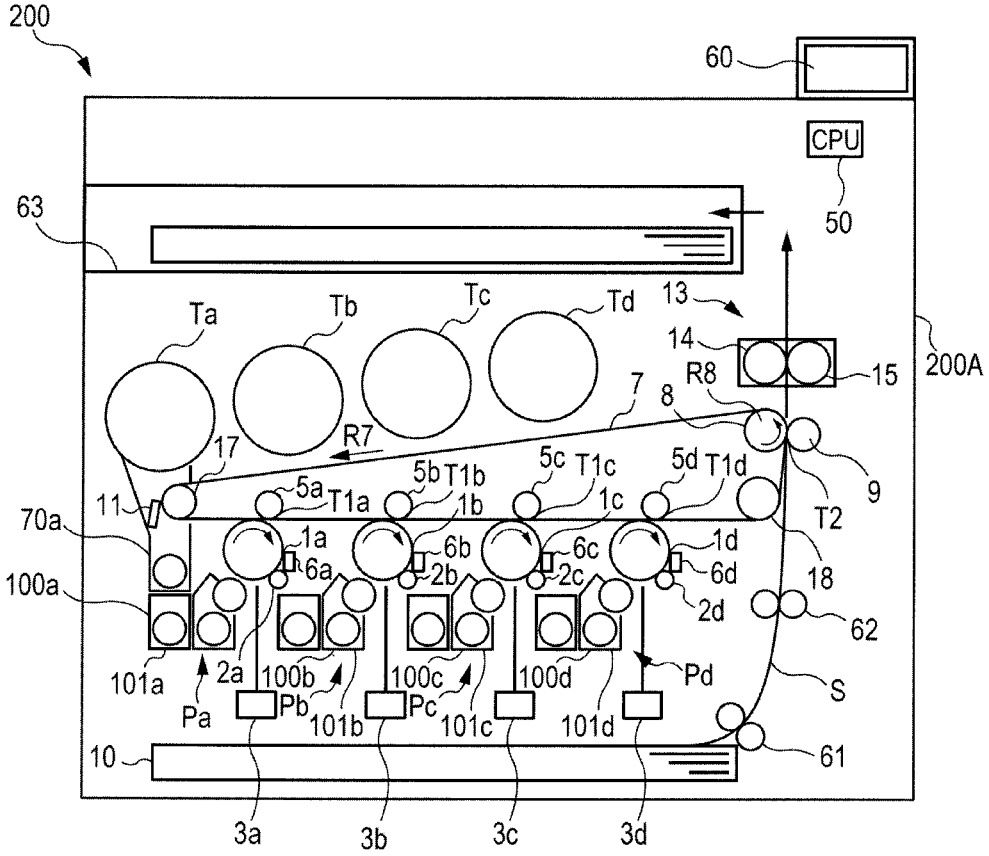
FIG. 1 is a sectional view illustrating an operation of a color image forming apparatus according to a first embodiment of the present invention.

An image forming apparatus 200 according to a first embodiment of the present invention is described. FIG. 1 is a sectional view of an electrophotographic color image forming apparatus, specifically, the image forming apparatus 200 is an image forming apparatus of what is called an intermediate transfer tandem type in which four-color image forming portions are arrayed above an intermediate transfer belt 7. The intermediate transfer tandem type is excellent in productivity and adaptable to conveyance of various media, and hence has become mainstream in recent years. A direction perpendicular to the drawing sheet of FIG. 1 corresponds to a near-and-far direction of the image forming apparatus.

<Conveying Process of Recording Material>

Recording materials S are received by being stacked in a storage 10, and are fed at appropriate timings with respect to image formation by feed rollers 61 employing a friction separation system. The recording materials S paid out by the feed rollers 61 are conveyed to registration rollers 62 through a conveying path. After skew feed correction and timing control by the registration rollers 62, the recording materials S are sent to a secondary transfer portion T2. The secondary transfer portion T2 is a transfer nip portion formed of an inner secondary transfer roller 8 and an outer secondary transfer roller 9 facing each other. The secondary transfer portion T2 applies a predetermined pressing force and a predetermined electrostatic load bias so as to attract toner images onto the recording materials S.

<Image Forming Portion>

A process of forming images to be conveyed to the secondary transfer portion T2 at the same timings with the recording materials S that are conveyed as described above by the conveying process until the secondary transfer portion T2 is described. Image forming portions Pa, Pb, Pc, and Pd mainly and respectively include photosensitive drums 1*a*, 1*b*, 1*c*, and 1*d* that serve as image bearing members, charging devices 2*a*, 2*b*, 2*c*, and 2*d*, exposure devices 3*a*, 3*b*, 3*c*, and 3*d*, developing devices 100*a*, 100*b*, 100*c*, and 100*d*, and developing containers 101*a*, 101*b*, 101*c*, and 101*d*. Further, the image forming portions Pa to Pd include primary transfer rollers 5*a*, 5*b*, 5*c*, and 5*d*, photosensitive member cleaners 6*a*, 6*b*, 6*c*, and 6*d*, and the like.

<Image Forming Process>

Surfaces of the photosensitive drums 1*a* to 1*d* are uniformly charged in advance respectively by the charging devices 2*a* to 2*d*. The photosensitive drums 1*a* to 1*d* are rotationally driven by a development driving device (not shown). The photosensitive drums 1*a* to 1*d* are exposed by the exposure devices 3*a* to 3*d* based on signals of image information to form electrostatic latent images thereon.

Next, the electrostatic latent images formed respectively on the photosensitive drums 1*a* to 1*d* are developed by the developing devices 100*a* to 100*d* and appear as toner images. Then, a predetermined pressing force and a predetermined transfer bias are applied by the primary transfer rollers 5*a* to 5*d*. With this, the toner images are transferred onto the intermediate transfer belt 7. Lastly, untransferred residual toner slightly remaining on the photosensitive drums 1*a* to 1*d* is collected by the photosensitive member cleaners 6*a* to 6*d*, to thereby prepare for subsequent image forming processes again.

When a toner amount in each of the developing devices 100*a* to 100*d* decreases, a toner is supplied from corresponding one of containers (also referred to as "toner containers") Ta, Tb, Tc, and Td (Tb, Tc, and Td have the same shape as that of the toner container Ta). The containers Ta to Td as the toner containers are arranged so as to be mountable to and removable from an apparatus main body.

Supply devices 70*a*, 70*b*, 70*c*, and 70*d* (the supply devices 70*b*, 70*c*, and 70*d* have the same shape as that of the supply device 70*a*, therefore the supply devices are collectively denoted by the reference numeral 70; the illustration of the supply devices 70*b* to 70*d* is omitted in FIG. 1; and each suffix corresponds to that for the development device) are driven in synchronization with the corresponding developing devices 100*a* to 100*d* so as to supply the toner. A supply operation is described later.

Figure 4:
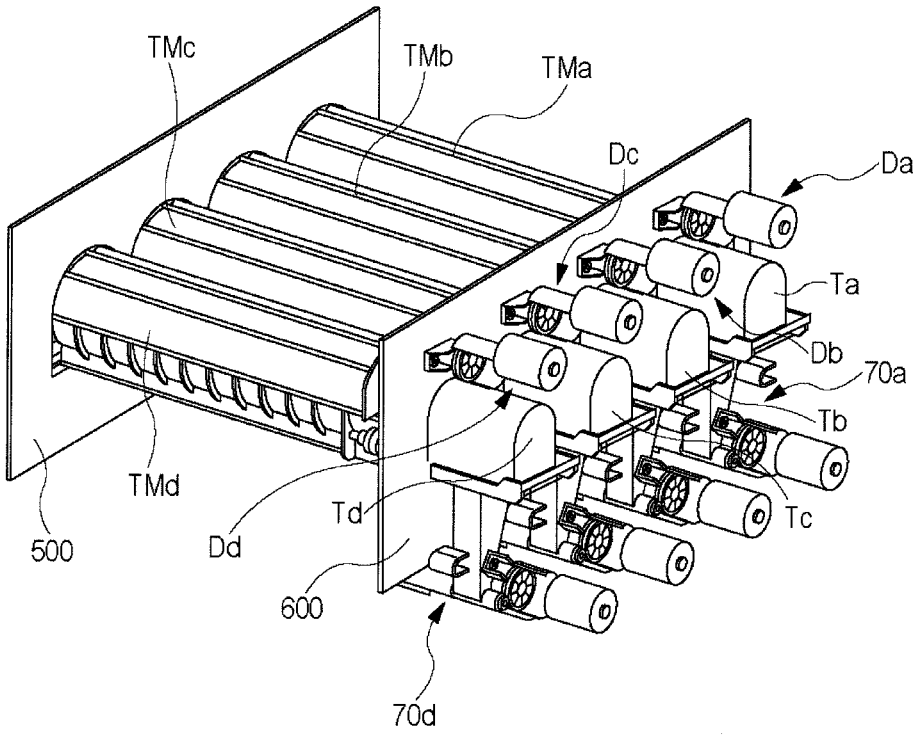
FIG. 4 is a top perspective view in an apparatus according to the first embodiment.

As illustrated in FIG. 4, the containers Ta to Td (see FIG. 1) are received and held respectively by holding members TMa, TMb, TMc, and TMd bridged between a front plate 500 and a rear plate 600. The holding members TMa to TMd are bridged independently of each other between the front plate 500 and the rear plate 600. A development driving device is fastened and installed onto the rear plate 600.

In the case illustrated in FIG. 1, the image forming portions Pa to Pd described above are four image forming portions respectively corresponding to yellow (Y), magenta (M), cyan (C), and black (Bk). However, colors are not limited to four colors, and order is not limited to the stated order. Further, the developing containers 101*a* to 101*d* contain in advance a two-component developer obtained by mixing a non-magnetic toner and a magnetic carrier. In some cases, however, a single-component developer containing only one of a magnetic toner and the non-magnetic toner may be used. This embodiment describes a case where the two-component developer (initial agent) is contained in the developing containers 101*a* to 101*d*.

With reference to FIG. 1, the intermediate transfer belt 7 is described. The intermediate transfer belt 7 is installed to an intermediate transfer belt frame (not shown). The intermediate transfer belt 7 is stretched around the inner secondary transfer roller 8, a tension roller 17, and an upstream secondary transfer roller 18, which serve as a drive transmission unit for the intermediate transfer belt 7. When the inner secondary transfer roller 8 is driven in a direction indicated by an arrow R8, the intermediate transfer belt 7 is driven in a direction indicated by an arrow R7. The intermediate transfer belt 7 is an endless belt. The image forming processes of the colors of Y, M, C, and Bk are executed parallel to each other respectively by the image forming portions Pa to Pd of the respective colors at such timings that the toner images are sequentially superimposed on preceding toner images of upstream colors, which are subjected to primary transfer onto the intermediate transfer belt 7. As a result, a full-color toner image is formed on the intermediate transfer belt 7, and finally conveyed to the secondary transfer portion T2. Note that, untransferred residual toner remaining even after passage through the secondary transfer portion T2 is collected by a transfer cleaning device 11.

<Process after Secondary Transfer>

By the conveying process and the image forming processes described above, the full-color toner images and the recording materials S reach the secondary transfer portion T2 at the same timings. Then, secondary transfer is performed. After that, the recording materials S are conveyed into a fixing device 13. In the fixing device 13, a fixing nip formed of opposed rollers 14 and 15 applies predetermined heat and pressure to the recording materials S passing therethrough. With this, the toner images are molten and fixed onto the recording materials S.

Thus, the fixing device 13 includes a heater as a heat source, and is controlled to constantly maintain an optimum temperature. After the images are fixed as described above, route selection as to whether the recording materials S are delivered onto a delivery tray 63 or conveyed to a reverse conveying device (not shown) in a case where duplex image formation is needed is performed.

<Container T>

Next, the containers Ta, Tb, Tc, and Td (hereinafter collectively denoted by the reference symbol "T" because the containers have the same shape) held by the holding members TMa, TMb, TMc, and TMd (hereinafter collectively denoted by the reference symbol "TM" because the holding members have the same shape) are described with reference to FIGS. 2A and 2B.

Figure 2A:
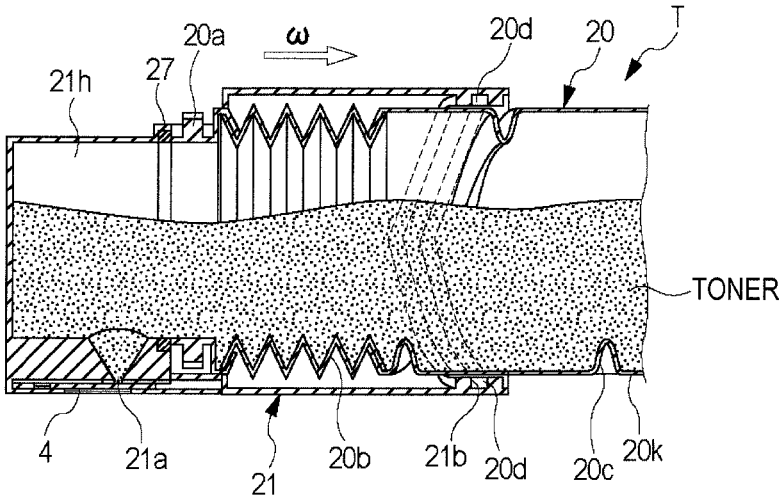
FIGS. 2A and 2B are sectional views of a toner container according to the first embodiment.

As illustrated in FIG. 2A, the container T configured to contain toner includes a toner containing portion 20 that is formed into a hollow cylindrical shape and has an interior space for containing the toner (indicated as "toner" in FIG. 2A). Further, the container T includes a flange portion 21 (also referred to as unrotatable portion) formed on one end side in a longitudinal direction of the toner containing portion 20 (developer conveying direction). Further, the toner containing portion 20 is configured to be rotated relative to the flange portion 21.

Figure 2B:
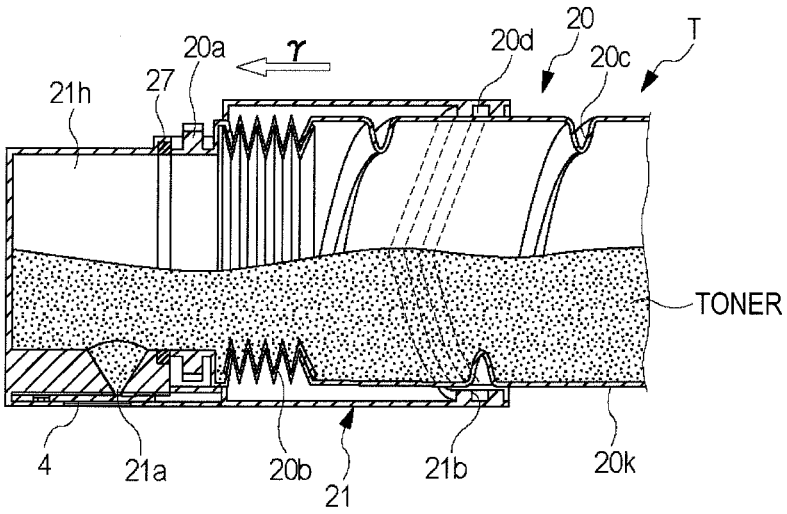

As illustrated in FIG. 2B, the flange portion 21 includes a hollow discharge portion 21*h* configured to temporarily pool the toner conveyed from an inside of the toner containing portion 20. Through a bottom portion of the discharge portion 21*h*, there is formed a small discharge port 21*a* configured to allow the toner to be discharged to an outside of the container T, in other words, to supply the toner to the supply device 70 (see FIG. 1). Further, in an inside of the flange portion 21, there is formed a shutter 4 configured to open and close the discharge port 21*a*. The shutter 4 includes a communicating port 4*a* communicable with the toner discharge port 21*a* formed through the container T. The shutter 4 is slid with respect to the container T so as to open and close the discharge port 21*a*. Movement of the shutter 4 is described below.

A pump portion 20*b* of this embodiment functions as an air intake/exhaust mechanism configured to alternately perform an air intake operation and an air exhaust operation through the discharge port 21*a*. As illustrated in FIG. 2B, the pump portion 20*b* is interposed between the discharge portion 21*h* and a cylindrical portion 20*k*, and is connected and fixed to the cylindrical portion 20*k*. In other words, the pump portion 20*b* is configured to be rotated integrally with the cylindrical portion 20*k*. Further, the pump portion 20*b* of this embodiment is configured to contain toner therein.

In this embodiment, a resin capacity-variable pump (bellows pump) that is variable in capacity along with reciprocation (arrow ω and arrow γ indicate moving directions of the pump portion 20*b*) is employed as the pump portion 20*b*. Specifically, as illustrated in FIGS. 2A and 2B, the bellows pump, which includes a plurality of "peak" portions and a plurality of "valley" portions that are regularly and alternately formed, is employed.

As illustrated in FIG. 2B, the pump portion 20*b* is fixed to be rotated relative to the discharge portion 21*h* under a state in which a ring-shaped sealing member 27 arranged along an inner surface of the flange portion 21 is compressed by an end portion on the discharge portion 21*h* side of the pump portion 20*b*.

The container T includes a gear portion 20*a*. This gear portion 20*a* is fixed to one end side in a longitudinal direction of the pump portion 20*b*. In other words, the gear portion 20*a*, the pump portion 20*b*, and the cylindrical portion 20*k* are configured to be rotated integrally with each other.

With this configuration, a rotational driving force input to the gear portion 20*a* is transmitted to the cylindrical portion 20*k* (conveying portion 20*c*) through intermediation of the pump portion 20*b*.

A groove portion 21*b* that functions as a driven portion, into which a cam projection 20*d* is fitted, is formed over the entire inner peripheral surface of the flange portion 21A. This groove portion 21*b* is described with reference to FIG.

Figure 3:
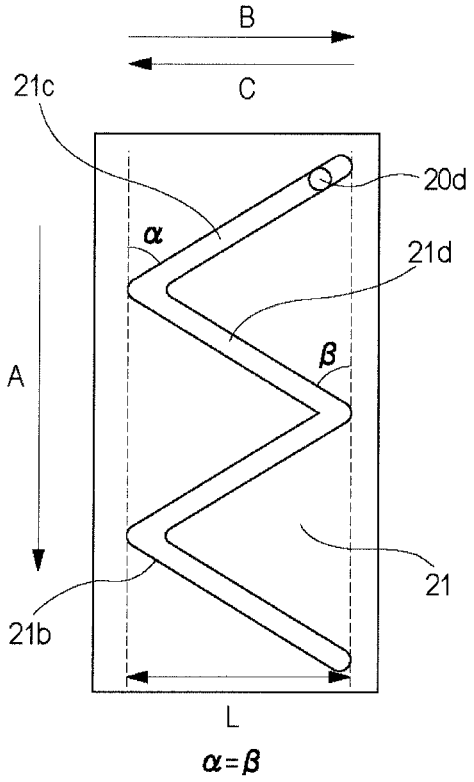
FIG. 3 is a partial enlarged view of the toner container according to the first embodiment.

3. In FIG. 3, an arrow A indicates a rotation direction of the cylindrical portion 20*k* (moving direction of the cam projection 20*d*), an arrow B indicates a stretching direction of the pump portion 20*b*, and an arrow C indicates a compression direction of the pump portion 20*b*.

Further, an angle α is formed between the rotation direction A of the cylindrical portion 20*k* and a groove part 21*c*, and an angle μ is formed between the rotation direction A and a groove part 21*d*. Still further, the groove portion 21*b* has an amplitude (stretching/compression length of the pump portion 20*b*) L in the stretching and compression directions B and C of the pump portion 20*b*.

Specifically, as illustrated in FIG. 3, which is a developed view of the groove portion 21*b*, in the groove portion 21*b*, the groove parts 21*c* each inclined from the cylindrical portion 20*k* to the discharge portion 21*h* and the groove parts 21*d* each inclined from the discharge portion 21*h* to the cylindrical portion 20*k* are coupled alternately to each other. In this embodiment, α=μ is established.

Thus, in this embodiment, the cam projection 20*d* and the groove portion 21*b* function as the drive transmission mechanism for the pump portion 20*b*. In other words, the cam projection 20*d* and the groove portion 21*b* function as a mechanism configured to convert the rotational driving force received by the gear portion 20*a* to a force in such a direction that the pump portion 20*b* is reciprocated (rotation axis direction of the cylindrical portion 20*k*), and to transmit this force to the pump portion 20*b*.

<Supply Configuration>

Figure 5:
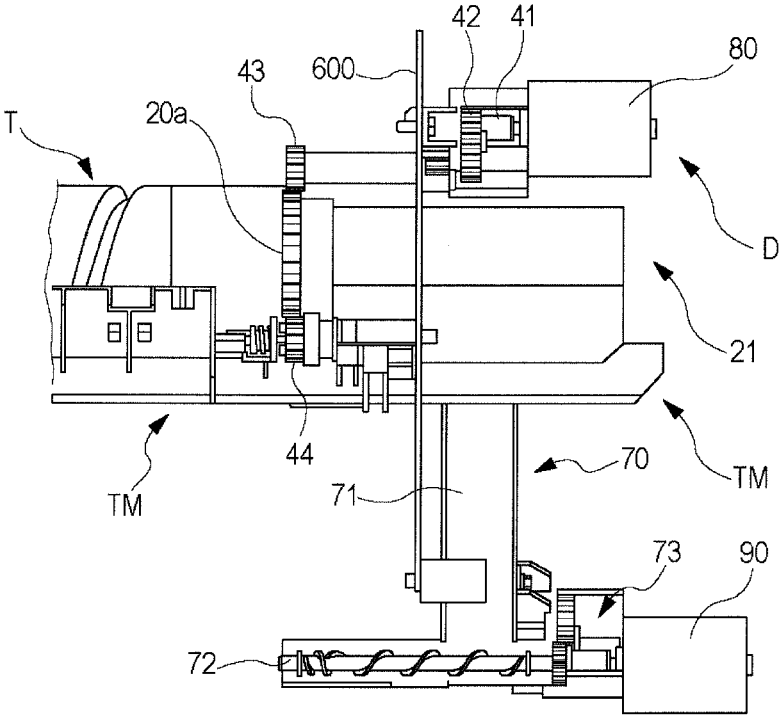
FIG. 5 is a right side view of the apparatus according to the first embodiment.

Next, a supply configuration for discharging the toner from the container T is described with reference to FIGS. 4 to 6. FIG. 4 is a top perspective view of interior of an apparatus main body 200A, and FIG. 5 is a right side view of the interior of the apparatus main body 200A. The container T is received removably by the holding member TM that is bridged between the front plate 500 and the rear plate 600.

Driving devices Da, Db, Dc, and Dd (hereinafter collectively denoted by the reference symbol "D" because the driving devices Da, Db, Dc, and Dd have the same shape) (supply driving devices) are installed onto the rear plate 600. Each of the driving devices D (see FIGS. 5, 7A, and 7B), functioning as a "driving unit" for transmitting a driving force to the container T, includes a motor 80 (bottle drive motor), and a gear 41, a gear 42 and a gear member 43 that are configured to reduce and transmit a driving force generated by the motor 80. The gear 41 is mounted to a shaft of the motor 80. A first stage 42*a* of the gear 42 having two stages is meshed with the gear 41. A gear 43*a* of the gear member 43 is meshed with a second stage 42*b* of the gear 42 having the two stages. A gear portion 20*a* arranged on an outer circumference of the container T is meshed with a gear 43*b* of the gear member 43.

With the above-mentioned configuration, the driving force generated by the motor 80 is transmitted to the gear 41, the gear 42, the gear member 43, and the gear portion 20*a*. The container T is driven by the driving of the gear portion 20*a*. Thus, an operation of supplying the toner to the container T can be performed.

Figure 6:
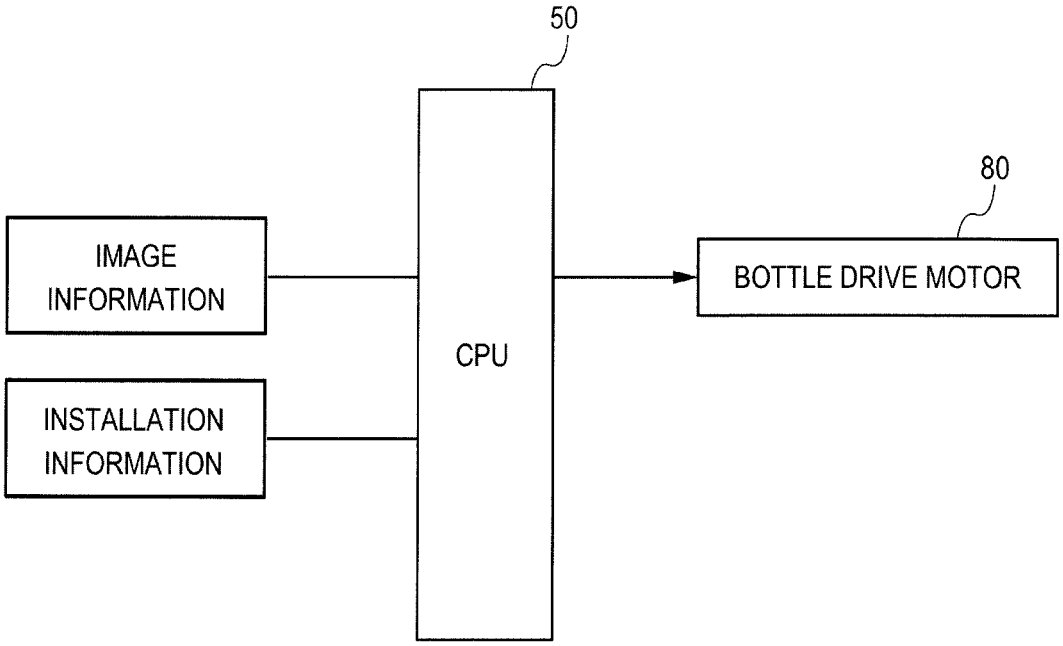
FIG. 6 is a control block diagram of the first embodiment.

FIG. 6 is a block diagram illustrating how a CPU performs control. As illustrated in FIG. 6, when receiving image information of the recording materials S to be output and installation information, the CPU 50 sends a rotation timing and a rotation time period of the motor 80. With this, a predetermined amount of toner is stably supplied from the container T into the supply device 70.

As illustrated in FIG. 5, the supply device 70 includes a containing portion 71 serving as a toner receiving portion, a conveying motor 90, and a screw 72 coupled to and driven by a gear train 73. The containing portion 71 is configured to contain toner therein. The conveying motor 90 is rotated in synchronization with the development driving device (not shown). With this, the toner conveyed into the supply device 70 is conveyed to the developing device 100 that closely contacts with the containing portion 71, and the image forming operation is performed.

At the time of transportation or shipping of the image forming apparatus 200, the developing devices 100 are installed inside the apparatus main body 200A to be packed in the same package. At this time, each of the developing devices 100 and the containing portion 71 are connected so as to be held in close contact with each other to form a toner path. The developer (initial agent) is contained in the developing device 100. Therefore, a closed region is on a side of the containing portion 71 (downstream side of the containing portion 71) which is connected to the developing device 100. An open region is on an upstream side of the containing portion 71.

<Release of Sealing of Container T>

An operation of releasing sealing of the container T, which is performed at the time of installation, is described.

In this embodiment, even in a state in which the containers T are mounted inside the apparatus main body 200A at the time of shipping of the image forming apparatus 200, the discharge port 21*a* of each of the containers T is closed by the shutter 4. Therefore, the toner is not supplied from (the toner does not leak from) the container T. On the other hand, in normal use for performing image formation, the shutter 4 opens in conjunction with the operation of mounting the container T.

In order to realize the above-mentioned configuration, a release device 300 is arranged. When the container T is mounted in the apparatus main body 200A, the release device 300 releases a state in which the discharge port 21*a* of the container T is closed by the shutter 4 to achieve a state (sealing released state) in which the shutter 4 is opened in conjunction with the operation of mounting the container T.

The release device 300 is movable from a state where the shutter 4 and the connecting device 400 (FIGS. 10A, 10A-b, 10B, and 10C) are separated away from each other to a state where the shutter 4 and the connecting device 400 are connectable to each other when the container T is mounted in the apparatus main body 200A. Now, the operation of releasing the sealing of the container T, which is performed at the time of installation, is described further in detail with reference to FIGS. 7A to 14.

In this embodiment, a position of a slider 30 of the release device 300 (see FIGS. 9A, 9A-b, and 9B) is set different in normal use from that at the time of shipping. By controlling a sliding amount of the shutter 4 when the container T is mounted, the sealing of the container T is realized. By the movement of the connecting device 400 (see FIGS. 10A to 10C) away from the container T, the inside of the containing portion 71 is kept at an atmospheric pressure.

Figure 7A:
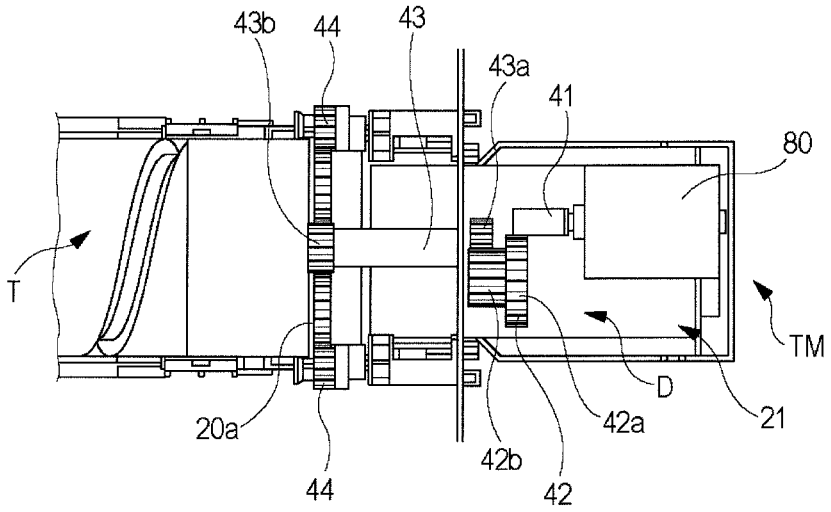
FIGS. 7A and 7B are top views in the apparatus according to the first embodiment.
Figure 7B:
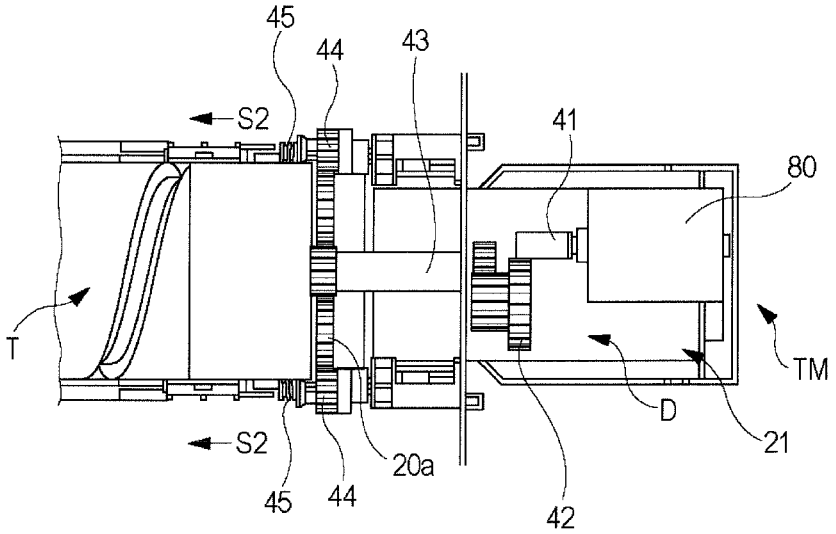
Figure 8A:
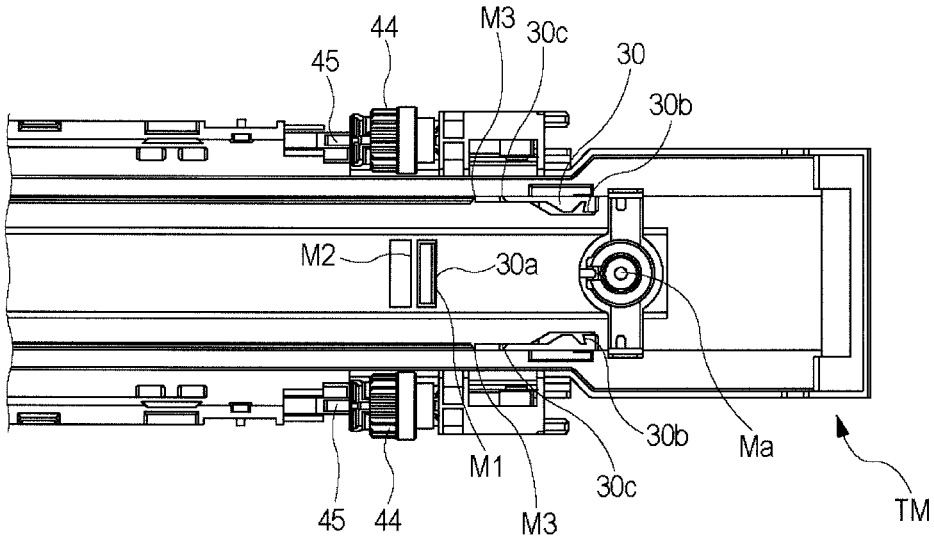
FIGS. 8A and 8B are top views in the apparatus according to the first embodiment (without the toner container).
Figure 8B:
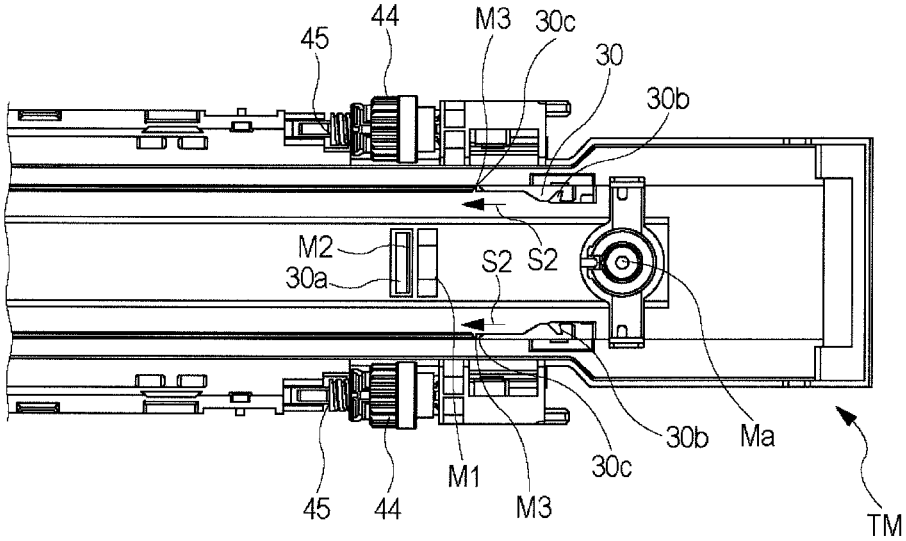
Figure 9A:
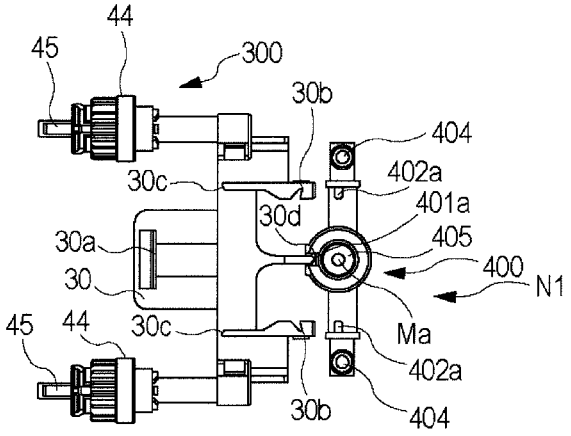
FIGS. 9A, 9A-b, and 9B are top views of a connecting device according to the first embodiment.
Figure 9A:
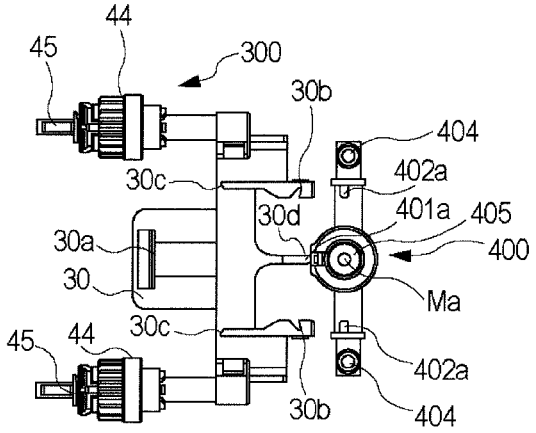
Figure 9B:
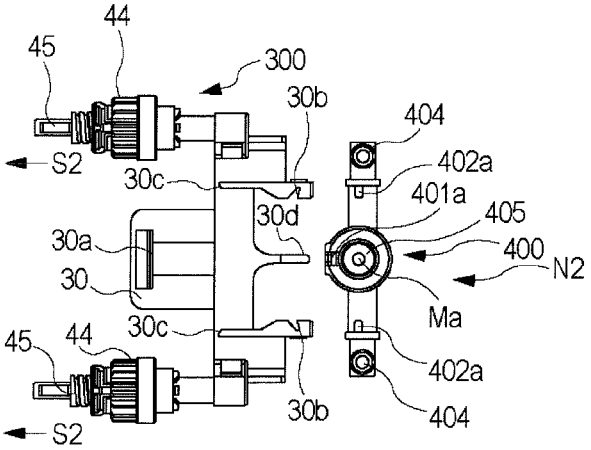
Figure 10A:
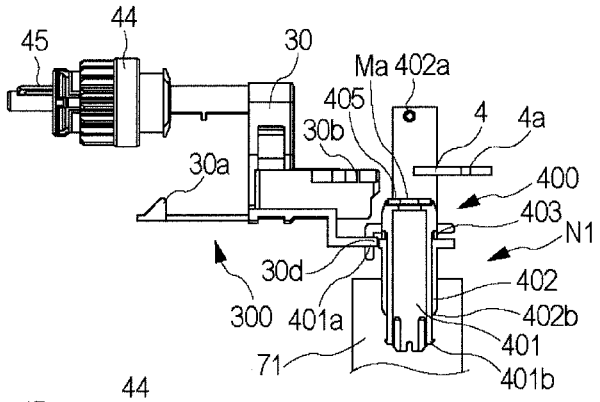
FIGS. 10A, 10A-b, 10B, and 10C are sectional views of the connecting device according to the first embodiment.
Figure 10A:
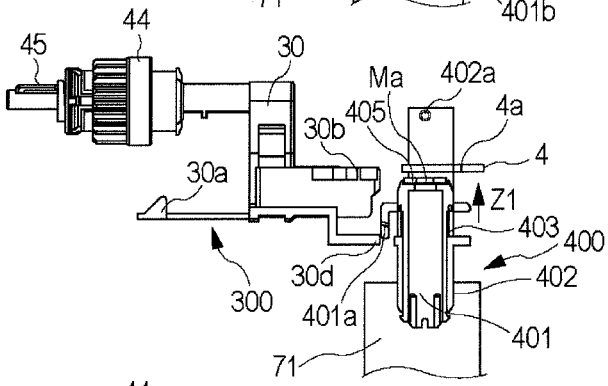
Figure 10B:
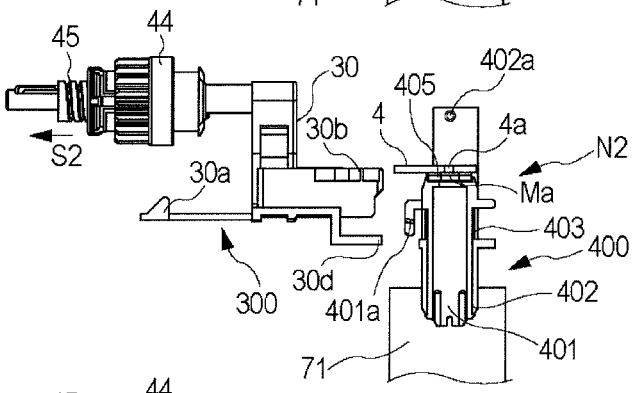
Figure 10C:
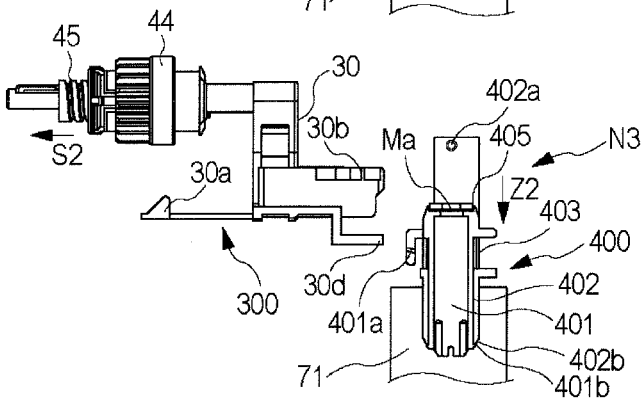
Figure 11:
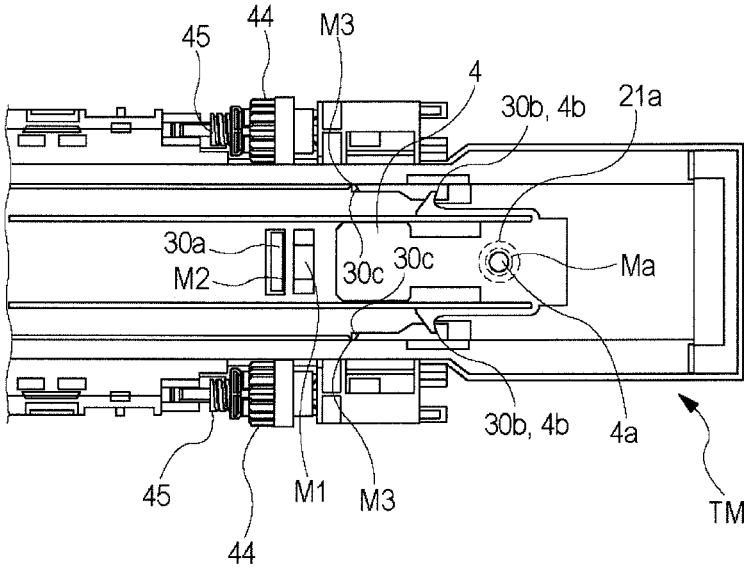
FIG. 11 is a top view in the apparatus according to the first embodiment (after the completion of installation of the toner container).
Figure 12A:
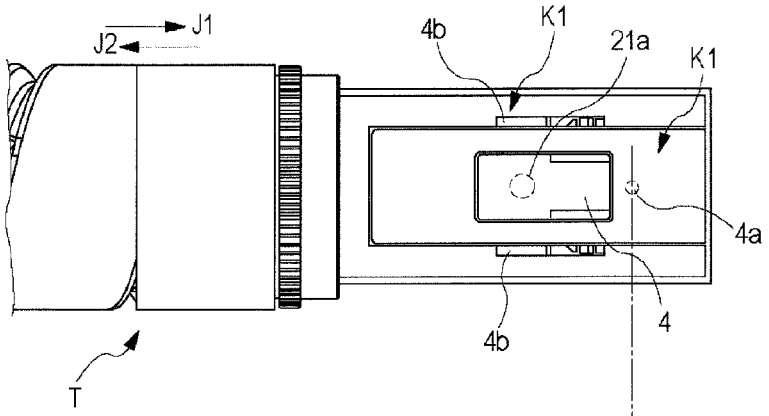
FIGS. 12A, 12B, and 12C are diagrams illustrating a sliding transition of the shutter according to the first embodiment.
Figure 12B:
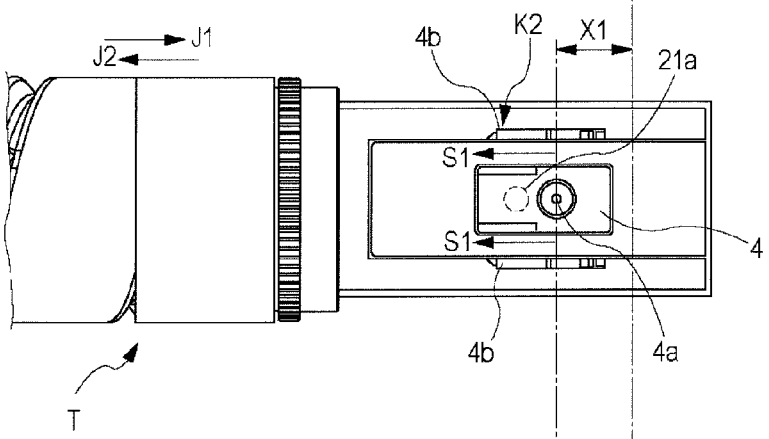
Figure 12C:
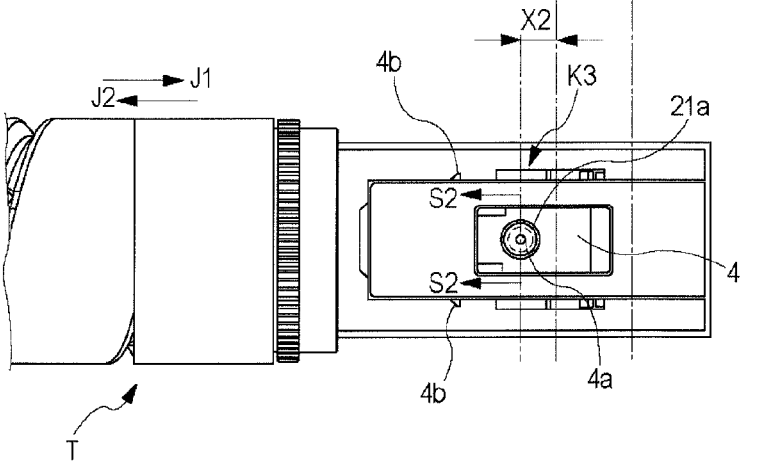
Figure 13:
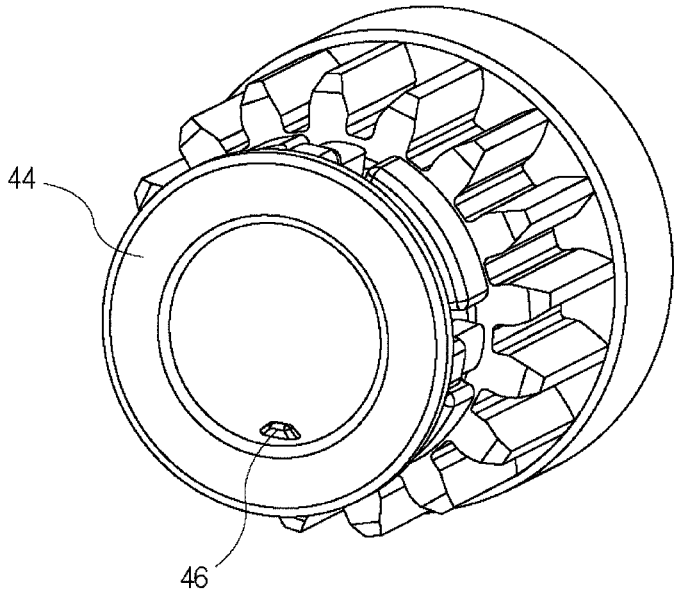
FIG. 13 is a perspective view of a slide gear according to the first embodiment.
Figure 14:
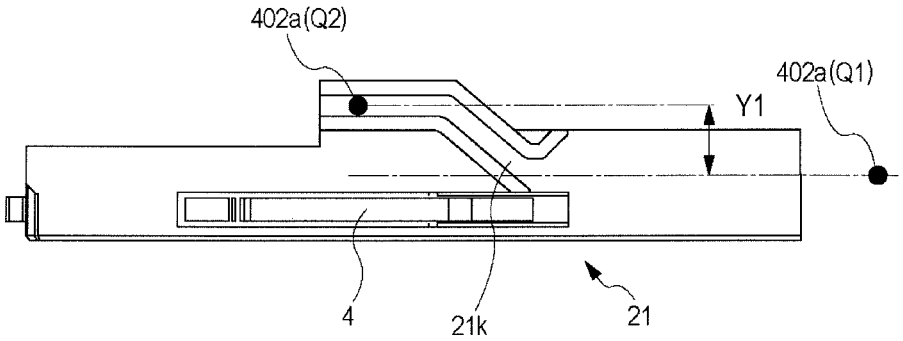
FIG. 14 is a partial enlarged view of the toner container according to the first embodiment.

FIGS. 7A and 7B are top views illustrating a state in which the container T is installed inside the apparatus main body 200A. FIGS. 8A and 8B are top views with the omission of the container T and the driving device D from FIGS. 7A and 7B. FIGS. 9A, 9A-b, and 9B are top views of the release device 300 and the connecting device 400, and FIGS. 10A, 10A-b, 10B, and 10C are sectional views of the release device 300 and the connecting device 400. FIG. 11 is a top view illustrating a state in which the shutter 4 is mounted in the state illustrated in FIGS. 8A and 8B. FIGS. 7A, 8A, 9A, and 10A are respectively detailed views of the portions in the same state. FIGS. 7B, 8B, 9B, and 10B are respectively detailed views of the portions in the same state. FIGS. 9A-b and 10A-b are detailed views of the portions in the same state and illustrate a transitional state from the state illustrated in FIG. 9A to the state illustrated in FIG. 9B and from the state illustrated in FIG. 10A to the state illustrated in FIG. 10B, respectively. FIGS. 12A to 12C are back surface views of the container T. FIG. 14 is a detailed view illustrating a state in which a lifting member 402 is moved up and down relative to a lifting groove 21*k* arranged to the flange portion 21. An operation thereof is described later.

The release device 300 is now described. In this embodiment, the position of the shutter 4 to be regulated inside the main body at the time of shipping and that in normal use are set different from each other so that the sliding amount of the shutter 4 differs when mounting the container T. In this embodiment, stop portions 30*b* functioning as first locking portions, which can be locked to the shutter 4, are movable relative to the main body. In this manner, the above-mentioned configuration is realized.

FIG. 7A corresponds to a top view before a claw 30*a* (see FIGS. 9A, 9A-b, and 9B) of the release device 300 for the shutter 4 is moved, and FIG. 7B corresponds to a top view after the claw 30*a* (see FIGS. 8A, 8B, 9A, 9A-b, and 9B) of the release device 300 for the shutter 4 is moved in a direction indicated by an arrow S2. The release device 300 for the shutter 4 includes driving slide gears 44 functioning as gears for converting rotational driving into sliding movement and worm gears 45 that move in a sliding manner respectively inside the slide gears 44 along with a rotating operation of the slide gears 44.

The gear 43*b* of the gear member 43 that functions as a driving input unit for the driving device D and the gear portion 20*a* that functions as a driving input unit for the container T are located in the same position in a direction in which the container T is inserted into or separated away from the apparatus main body 200A. Similarly, the gear 43*b* of the gear member 43 and the slide gears 44, which function as a driving input unit for the release device 300, are located in the same position in the direction in which the container T is inserted into or separated away from the apparatus main body 200A. By the driving force transmitted from the driving device D that transmits the driving force to the container T, an operation of discharging the toner from the container T is performed.

The release device 300 is driven by the driving force transmitted from the driving device D to the container T. By the driving of the release device 300, the sealing by the shutter 4 is released. Further, the state of the connecting device 400 transitions from the separated state to the connected state with respect to the container T by the driving force transmitted from the driving device D to the container T. The transition of the state of the connecting device 400 is described later.

In a process of a transition from the state illustrated in FIG. 7A to that illustrated in FIG. 7B, when the gear portion 20*a* of the container T rotates, the slide gears 44 that are brought into meshing engagement with the gear portion 20*a* also rotate. Along with the rotation of the slide gears 44, the worm gears 45 respectively move inside the slide gears 44 in the direction indicated by the arrow S2. By the movement of the worm gears 45 in the direction indicated by the arrow S2, the claw 30*a* for releasing the sealing by the shutter 4 moves in the direction indicated by the arrow S2.

FIG. 8A corresponds to a top view before the movement of the claw 30*a* (see FIGS. 9A, 9A-b, and 9B) of the release device 300 for the shutter 4. FIG. 8B corresponds to a top view after the claw 30*a* (see FIGS. 9A, 9A-b, and 9B) of the release device 300 for the shutter 4 is moved in a direction indicated by the arrow S2. The release device 300 for the shutter 4 includes the claw 30*a*. The holding member TM includes an opening Ma, a fixing portion M1, and a fixing portion M2 in the stated order in the direction indicated by the arrow S2. The claw 30*a* is inserted in the fixing portion M1 in FIG. 8A, whereas the claw 30*a* is inserted in the fixing portion M2 in FIG. 8B.

FIG. 9A corresponds to a top view before the claw 30*a* of the release device 300 for the shutter 4 is moved. FIG. 9B corresponds to a top view after the claw 30*a* of the release device 300 for the shutter 4 is moved in the direction indicated by the arrow S2. It is understood that the claw 30*a* is moved in the direction indicated by the arrow S2 along with the movement of the worm gears 45 in the direction indicated by the arrow S2. The release device 300 includes the slider 30. The slider 30 includes the single claw 30*a* and the two stop portions 30*b* as the first locking portions. A restricting portion 30*c* is formed on each of the stop portions 30*b*. FIGS. 10A, 10A-b, 10B, and 10C correspond to sectional views of FIGS. 9A, 9A-b, and 9B.

<Connecting Device>

The connecting device 400 is now described. The connecting device 400 is arranged movably between the container T and the containing portion 71 so that the toner conveying path can be formed. Further, the connecting device 400 can be brought into contact with and separated away from the shutter 4 in conjunction with the operation of mounting the container T. The connecting device 400 can prevent the toner from leaking through the discharge port of the container T during the toner discharging operation. The above-mentioned operation of the connecting device 400 is described in detail below.

FIGS. 9A-b and 10A-b respectively correspond to a top view and a sectional view during the movement of the claw 30*a*. In FIGS. 9A-b and 10A-b, the state of the connecting device 400 is transitioning from the separated state to the connected (contact) state with respect to the container T.

The operation of the connecting device 400 is now described. The connecting device 400 that is a "connecting unit" includes: a connecting pipe 401 serving as a connecting member; the lifting member 402 fitted over the connecting pipe 401; and a separating spring 403 which biases the connecting pipe 401 upward in FIGS. 10A, 10A-b, 10B, and 10C. The connecting device 400 further includes: lifting springs 404 which bias the lifting member 402 downward in FIGS. 10A, 10A-b, 10B, and 10C; and a connecting seal 405 having flexibility to form the opening Ma and arranged on the connecting pipe 401. The connecting seal 405 is arranged to be brought into abutment against the shutter 4 so as to be elastically deformable when the connecting pipe 401 is connected to the shutter 4. In this manner, the connecting seal 405 can seal a periphery of the communicating port 4*a*.

A regulating portion 401*a* provided to the connecting pipe 401 is brought into engagement with a claw 30*d* as a second locking portion arranged to the slider 30 of the release device 300. In the state illustrated in FIG. 10A, movement of the connecting pipe 401 in a direction indicated by an arrow Z1 illustrated in FIG. 10A-b is regulated. At this time, the connecting seal 405 and the shutter 4 for the container T are not connected to each other. A profile of the lifting member 402 is placed inside the containing portion 71 and is liftably sealed (the connecting device 400 in a first position N1). Further, lifting projections 402*a* provided to the lifting member 402 allow the lifting member 402 to be moved up and down in a vertical direction illustrated in FIGS. 10A, 10A-b, 10B, and 10C along the lifting groove 21*k* provided to the flange portion 21 of the container T, as illustrated in FIG. 14. The lifting groove 21*k* is also provided on an opposed side (not shown) in the same shape to guide the lifting projection 402*a*. The relationship between the lifting groove 21*k* and the lifting projection 402*a* is described in detail later.

When the connecting device 400 is in the first position N1 (FIG. 10A), the shutter 4 arranged to the container T and the connecting seal 405 are not connected to each other and have a predetermined interval therebetween. Therefore, in a state in which the container T and the apparatus main body 200A are packed in the same package, the containing portion 71 is kept at the atmospheric pressure even during transportation.

At this time, the closed region is on the downstream side of the containing portion 71. Therefore, only the opening Ma provided on the connecting seal 405 communicates with the atmosphere.

When the release device 300 moves from the state illustrated in FIGS. 9A and 10A to the state illustrated in FIGS. 9A-b and 10A-b, the claw 30*d* is disengaged from the regulating portion 401*a* to move the regulating portion 401*a* in the direction indicated by the arrow Z1. The connecting pipe 401 is pressurized by the separating spring 403. Therefore, the connecting seal 405 arranged to the connecting pipe 401 is biased until the connecting seal 405 abuts against the shutter 4 for the container T to be brought into close contact therewith.

In the state illustrated in FIGS. 9B and 10B (the connecting portion 400 is in a second position N2), the shutter 4 and the connecting seal 405 are brought into close contact with each other, and the communicating port 4*a*, the opening Ma, and the discharge port 21*a* are aligned coaxially with each other. At this time, the communicating port 4*a* can communicate with the discharge port 21*a* of the container T.

The claw 30*d* as the second locking portion is movable from the first position N1 (FIG. 10A) to the second position N2 (FIG. 10B). Specifically, the claw 30*d* can be located in the position (first position N1) in which the connecting pipe 401 is prevented from being connected to the shutter 4 in a state in which the container T is mounted to the main body. Further, the claw 30*d* can also be located in the position (second position N2) in which the connecting pipe 401 is not prevented from being connected to the shutter 4 in the state in which the container T is mounted in the main body.

<Operation of Bringing Communicating Port of Shutter and Toner Container into Communication>

An operation performed until the communicating port 4*a* provided to the shutter 4, the opening Ma provided to the holding member TM, and the discharge port 21*a* of the container T are aligned is described below with reference to FIGS. 12A, 12B, and 12C.

A positional relationship between the discharge port 21*a* formed in the flange portion 21 of the container T and the communicating port 4*a* provided in the shutter 4 is described below with reference to FIGS. 12A, 12B, and 12C.

As illustrated in FIG. 12A, the positional relationship between the communicating port 4*a* formed in the shutter 4 and the discharge port 21*a* formed in the flange portion 21 of the container T is set so that the communicating port 4*a* and the discharge port 21*a* are not aligned in a state in which the container T is not installed in the apparatus main body 200A. Therefore, the shutter 4 seals the discharge port 21*a* so that the toner in the container T does not leak to the outside. At this time, the shutter 4 is located in a first position K1 that is a position of the shutter 4 before the container T is inserted into the apparatus main body 200A of the image forming apparatus 200.

FIG. 12B illustrates the positional relationship between the communicating port 4*a* and the discharge port 21*a* at the time of transportation or shipping of the image forming apparatus 200.

As a result of insertion of the container T into the apparatus main body 200A, the shutter 4 reaches a set position (position in which the shutter 4 is locked to the stop portions 30*b*) in the container T on a rear side of the apparatus main body 200A at the time when the container T is inserted to a given position. In FIGS. 12A to 12C, a direction indicated by an arrow JI is an inserting direction, whereas a direction indicated by an arrow J2 is a separating direction. In the set position, the locking portions 4*b* of the shutter 4 for the container T are brought into engagement with the stop portions 30*b* of the slider 30 of the release device 300 (engage as illustrated in FIG. 11). At this time, the claw 30*a* of the slider 30 is locked by the fixing portion M1 provided to the holding member TM. Therefore, the movement of the slider 30 in the direction of insertion of the container T is regulated (see FIG. 8A). When the container T is further inserted into the apparatus main body 200A, the locking portions 4*b* of the shutter 4 slide in the direction indicated by an arrow S1 relative to the flange portion 21 by a predetermined amount so that the state transitions to a state illustrated in FIG. 12B.

At the time of transportation or shipping of the image forming apparatus 200, the container T is in the state illustrated in FIG. 12B. At this time, the discharge port 21*a* and the communicating port 4*a* remain unaligned. Specifically, in a state in which the container T is mounted, the shutter 4 can be located in a non-communicating position in which the communicating port 4*a* and the discharge port 21*a* are not brought into communication with each other. Therefore, even at the time of transportation and shipping, the toner does not leak from the container T. FIGS. 7A, 8A, 9A, and 10A illustrate the state at this time. The discharge port 21*a* of the container T is aligned coaxially with the opening Ma that is provided to the holding member TM to form the path leading to the containing portion 71. At this time, the shutter 4 is located in a second position K2 that is a position of the shutter 4 when the container T is mounted in the apparatus main body 200A.

As illustrated in FIG. 14, along with the insertion of the container T into the apparatus main body 200A, the lifting projection 402*a* moves from a position Q1 along the lifting groove 21*k* by a distance Y1 (to a position Q2).

The lifting projection 402*a* remains in the position Q2 without moving therefrom even during the operation of releasing the sealing by the shutter 4. FIGS. 9A and 10A illustrate a state of the connecting device 400 at this time.

<Release Device>

When the apparatus main body 200A is installed, the release device 300 is operated to enable the toner to be discharged from the container T. Now, a specific configuration of the release device 300 is described. The release device 300 that is a "release unit" uses the driving force transmitted from the driving device D to the container T to release the sealing by the shutter 4. As illustrated in FIGS. 9A, 9A-b, 9B, 10A, 10A-b, 10B, and 10C, the release device 300 includes the slider 30 including the claw 30*a*, the stop portions 30*b*, and the restricting portions 30*c*, the two slide gears 44, and the two worm gears 45. The release device 300 is installed to the holding member TM.

The worm gears 45 are fixed to the slider 30 and move integrally with the slider 30 during the operation. The slide gears 44 are rotatable relative to the worm gears 45 and have such a relationship that the slide gears 44 are respectively fitted into the worm gears 45 so as to be coaxial therewith. When each of the slide gears 44 rotates, the corresponding worm gear 45 can be moved in a thrust direction of the slide gear 44 by a projection 46 (see FIG. 13) provided on the inner side of the slide gear 44. As illustrated in FIG. 7A, the slide gear 44 is arranged in a position in which the slide gear 44 is meshed with the gear portion 20*a*.

As illustrated in FIG. 6, the CPU 50 rotates the gear portion 20*a* to which the driving is input from the motor 80 for a predetermined time period based on the installation information. When the driving is transmitted to the slide gears 44, the worm gears 45, the slider 30, and the claw 30*a* start moving. In the middle of the movement of the slider 30, the claw 30*d* is disengaged from the regulating portion 401*a* as illustrated in FIGS. 9A-b and 10A-b. As a result, the connecting seal 405 is biased until the connecting seal 405 abuts against the shutter 4 for the container T to be brought into close contact therewith. From then on, the claw 30*d* is not brought into engagement with the regulating portion 401*a*.

When the projection 46 reaches a distal end of corresponding one of the worm gears 45, the worm gear 45 terminates the predetermined amount of movement in the direction indicated by the arrow S2. At the same time, the claw 30*a* is moved to the fixing portion M2 to be locked thereto (see FIG. 11). Therefore, the movement of the slider 30 in the direction of insertion of the container T is regulated again.

Further, the restricting portions 30*c* abut against abutment portions M3 (see FIG. 11). Therefore, the movement of the slider 30 in the direction of removing the container T is also regulated. Specifically, the movement of the slider 30 is completely regulated. Thus, from then on, the slider 30 does not move even when the container T is inserted or removed, or the driving is input from the motor 80 (the slider 30 is located in a normal position).

The state at this time is illustrated in FIGS. 7B, 8B, 9B, 10B, 11, and 12C. In this step, the discharge port 21*a*, the communicating port 4*a*, and the opening Ma are aligned coaxially. A gear ratio of the gear portion 20*a* and each of the slide gears 44 is set so that the pump portion 20*b* performs an intake operation over a time period from the start of communication of the communicating port 4*a* of the shutter 4 to the completion of the communication. Specifically, during a process in which the discharge port 21*a*, the communicating port 4*a*, and the opening Ma are aligned coaxially, the toner does not flow into the containing portion 71.

From then on, the toner can be supplied from the container T by operating the motor 80. At this time, the shutter 4 is located in a third position K3 (see FIG. 12C) that the shutter 4 reaches as a result of driving of the driving device D, whereas the connecting device 400 is in the second position N2 (see FIG. 10B). The toner can be discharged when the shutter 4 is in the third position K3 and the connecting device 400 is in the second position N2.

When the container T is removed from the apparatus main body 200A, the connecting device 400 is located in a third position N3 as illustrated in FIG. 10C. The connecting pipe 401 is locked in a position at which the claw 401*b* abuts against the locking portion 402*b* of the lifting member 402 under the pressurization by the separating spring 403, and moves up and down integrally as the connecting device 400. At this time, as illustrated in FIG. 14, the lifting projection 402*a* is also moved from the position Q2 to the position Q1 by the distance Y1. The connecting device 400 is maintained in the third position N3 by the pressurizing force by the lifting springs 404.

From then on, the connecting device 400 is maintained in the second position N2 when the container T is installed. On the other hand, the connecting device 400 is maintained in the third position N3 when the container T is removed, thereby dealing with the replacement of the container T.

As described above, the shutter 4 is movable between the first position K1, the second position K2, and the third position K3, and the connecting device 400 is movable between the first position N1, the second position N2, and the third position N3.

In this embodiment, the slider 30 is moved to the normal position to bring the communicating port 4*a* and the opening Ma into communication with each other. Therefore, after the slider 30 is moved to the normal position, the shutter 4 is opened and closed based on the mounting and removal of the container T.

Specifically, when the container T is not inserted into the apparatus main body 200A, the shutter 4 in the state illustrated in FIG. 12A is moved by a movement amount x1+x2 along with the insertion of the container T to be placed in the state illustrated in FIG. 12C. As a result, the insertion is completed to enable the supply of the toner. (At this time, in a state in which the container is mounted, the shutter 4 can be located in the communicating position in which the communicating port 4*a* and the discharge port 21*a* are brought into communication with each other.) The release device 300 releases the sealing by the shutter 4 only when the driving device D is driven for the first time. The shutter 4 is mounted to the container T. When the container T is inserted into the apparatus main body 200A of the image forming apparatus 200, the shutter 4 is slid in the opposite direction (direction indicated by the arrow S1 or direction indicated by the arrow S2) to the inserting direction (direction indicated by an arrow J1). Further, when the container T is separated away from the apparatus main body 200A, the shutter 4 is slid in the opposite direction (direction opposite to the direction indicated by the arrow S1 or the direction indicated by the arrow S2) to the separating direction (direction indicated by the arrow J2).

With the configuration of the embodiment described above, when the image forming apparatus 200 is not installed, the container T and the connecting device 400 are kept separated away from each other in a state in which the container T is mounted in the apparatus main body 200A and packed in the same package. Therefore, a load is not applied to the connecting seal 405. Therefore, when the container T and the connecting device 400 are connected to each other after the installation of the image forming apparatus 200, poor connection due to deformation or damage of the connecting seal 405 is prevented. As a result, the toner can be prevented from spilling out.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-062358, filed Mar. 25, 2014, which is hereby incorporated by reference herein in its entirety.

What is claimed is:

1. An image forming apparatus comprising:

a bottle which is detachably attached to a mounting portion and which stores toner, the bottle having a discharge port from which the toner stored is discharged;

a shutter which is disposed on the bottle to open and close the discharge port, the shutter having a communicating port which is brought into communication with the discharge port; and an engaging member which is movably disposed and configured to engage with the shutter, wherein, in a case that the engaging member is in an operating position, the engaging member engages with the shutter so as to open the discharge port by an attaching operation of the bottle into a set position, and wherein, in a case that the engaging member is in a non-operating position where the engaging member is retracted from the operating position, the shutter maintains a closed status of the discharge port when the bottle is attached at the set position;

a receiving device receiving the toner supplied from the bottle;

a connecting member which is displaceable between the bottle located at the set position and the receiving device, and is connectable to the shutter when the bottle is attached at the set position; and a seal member which is compressed between the connecting member and the shutter to seal a periphery of the communicating port, wherein, in a case that the bottle is located at the set position in a state that the engaging member is in the operating position, the connecting member is connected to the shutter, and wherein, in a case that the bottle is located at the set position in a state that the engaging member is in the non-operating position, the connecting member is spaced apart from the shutter.

2. The image forming apparatus according to claim 1, further comprising:

a biasing member biasing the connecting member toward the shutter when the bottle is at the set position; and a regulating portion which is provided in an apparatus main body and enables to regulate connection between the connecting member and the shutter, wherein, in the case that the bottle is located at the set position in the state that the engaging member is in the operating position, the regulating portion permits the connecting member to connect to the shutter, and wherein, in the case that the bottle is located at the set position in the state that the engaging member is in the non-operating position, the regulating portion regulates that the connecting member is connected to the shutter.

3. The image forming apparatus according to claim 2, further comprising a driving motor configured to drive the bottle, wherein the driving motor drives the engaging member and a regulating portion which is provided in an apparatus main body and enables to regulate connection between the connecting member and the shutter.

4. The image forming apparatus according to claim 3, wherein the engaging member and the regulating portion are configured integrally.

5. The image forming apparatus according to claim 1, wherein, when the engaging member is moved from the non-operating position to the operating position in a state that the bottle is located at the set position, the communicating port and the discharge port are brought into communication with each other after the connecting member is connected to the shutter.

6. The image forming apparatus according to claim 1, wherein, in a case that the engaging member is located in the operating position, the connecting member is connected to the shutter after the shutter is locked by the engaging member in conjunction with an operation of mounting the bottle, and the communicating port and the discharge port are brought into communication with each other after the connecting member is connected to the shutter.

* * * * *